United States Patent [19]

Ratanangsu

[11] 4,080,867

[45] Mar. 28, 1978

[54] ELECTRONIC DISPLAY SYSTEM FOR MUSICAL INSTRUMENTS

[76] Inventor: Srinkarn Ratanangsu, 7752 Bellaire Ave., North Hollywood, Calif. 91605

[21] Appl. No.: 615,788

[22] Filed: Sep. 22, 1975

[51] Int. Cl.[2] ..... G10B 15/00; G10F 5/00

[52] U.S. Cl. ..... 84/477 R; 84/115; 84/267; 84/478

[58] Field of Search ..... 84/1.01, 1.02, 1.03, 84/1.16, 1.28, 115, 267, 464, 470, DIG. 30, 477 R, 478

[56] References Cited

U.S. PATENT DOCUMENTS

| | | | |
|---|---|---|---|
| 3,771,406 | 11/1973 | Wheelwright | 84/464 |
| 3,881,390 | 5/1975 | Gullickson | 84/478 |
| 3,895,554 | 7/1975 | Maillet | 84/115 |

*Primary Examiner*—Stanley J. Witkowski
*Attorney, Agent, or Firm*—Lyon & Lyon

[57] ABSTRACT

There is disclosed herein an electronic digital system for allowing encoding and storage of note value and time value for one or more musical instruments and which, upon playback, controls a light display to indicate to the musician the notes to be played and their time value. The system is particularly described for use with guitars, and similar instruments, and has an X-Y display to indicate, for example, both the particular string and the note to be played, as well as the time value of the note. In addition, the system will accommodate a plurality of such musical instruments to thereby enable display of the notes to be played, and their time values, for all of the instruments simultaneously. The system includes a keyboard for entering note value and note timing for each of one or more instruments, and a memory for storing data bits indicative of the notes for each instrument and the timing thereof. The system further includes time multiplexing for appropriately encoding the time values of the notes, such as one-eight note, one-quarter note, one-half note, and full note. The data can then be recorded serially on a serial data recorder, such as on a standard cassette recorder. For playback, the serial data from a cassette is converted into parallel data and appropriately channelled to each of the instruments for display. The system can, in the playback mode, pass the data through the memory to the displays of the musical instruments so as to enable the playback rate to be decreased as, for example, in teaching the playing of a song at a slow rate. Finally, each of the musical instruments involved has a light display, such as light-emitting diodes, which indicate the note and time values.

4 Claims, 22 Drawing Figures

TO FIG. 6.
TO SERIAL DATA REC.
UART
DELAY TIMER
ECCD
EOC
A CLK
MEM. 1.
MEM. 2.
DATA IN
R W
CE1
CE2
LATCH
DAVD
LATCH SW. (KEY BD)
ADD. REGISTER 14
LOAD
CLK.
DAV.
FROM KEY BD.
R.W.

B-CLOCK
TIMER
RESET
TRANSMIT
RECEIVE SW.
START SW.
DELAY 1
1 MS
DELAY 2
1 MS
TO GATES 149-152
COUNTER CLK
RESET
EOCD
EOC
DAV
SERIAL DATA OUTPUT OF RECORDER

ELECTRONIC DISPLAY SYSTEM FOR MUSICAL INSTRUMENTS

BACKGROUND AND SUMMARY OF THE INVENTION

The present invention relates to musical systems, and more particularly to a digital electronic system for encoding, storing and decoding of musical note values and time values therefor for ultimate display at a musical instrument for indicating the proper notes to be played at their time values.

Various attempts have been made to facilitate learning in the playing of a musical instrument or the learning of a new musical composition. Applicant is unaware of any entirely satisfactory method or device which provides a significant aid to either the relatively untrained individual who desires to play a musical instrument or the trained individual who desires to rapidly learn a new musical composition or song. Typically, one must become familiar with the instrument and music, including the various notes and time values thereof, and then must tediously practice to become proficient on the instrument or in successfully performing a new composition. Although various devices have been developed, such as attachments for guitars, chord organs, overlays and lights for keyboard instruments, and so forth, none provides a significant solution. One suggested approach for keyboard instruments is described in U.S. Pat. No. 3,771,406 wherein data representative of notes is encoded and stored, and then replayed to operate lights adjacent respective keys of an electronic organ.

On the other hand, applicant has developed a system which is believed to substantially simplify the process of learning to play a musical instrument, and which readily allows one or more persons to play or learn a composition together. While not intended to be limited thereby, the present invention in a preferred form is described for use with guitars and similar types of stringed instruments. In this preferred form, the display provided, and which is controlled by the system of the present invention, is in the form of an X-Y display to indicate both the string to be played and the note to be played on that particular string, as well as the time value or duration of the note. In an exemplary embodiment, the system accommodates three guitars to enable three persons to play together.

In the preferred exemplary embodiment, the system can be programmed to display the location of the note to be played on instruments such as lead guitar, bass guitar and chord guitar. The system includes a recording system for recording data indicative of the notes for each instrument and the time values. The system further includes a playback system for allowing playback from a storage medium, such as a standard cassette, and conversion of the data to drive appropriate displays on the musical instruments.

The exemplary system includes an entry keyboard for entering data bits indicative of the notes to be played and for entering data bits indicative of the time values of the notes. In addition, the keyboard enables addressing of a memory so as to change any stored data bits as desired. The keyboard also provides other functions such as start (or run), stop, clear, and so forth. The keyboard communicates through an interface with a read/write memory having a capacity, for example, of 2048 data words. A number of data words are stored in the memory representing a number of notes of a song for one or more instruments and the time values of the notes. Then, these data words can be read from the memory and multiplexed in a time fashion to provide a serial data output representative of the notes and time values. This serial data is recorded on a suitable storage medium, such as on a standard cassette by a standard cassette recorder.

The playback unit receives the serial data from the cassette, converts the data words into parallel data, and then decodes or multiplexes the data to provide signals to the displays of each of the instruments.

It is a principal object of the present invention to provide an improved electronic system for enabling display of musical note value and time value therefor.

Another object of this invention is to provide a new electronic system for driving an X-Y display for a musical instrument for indicating notes and time values therefor.

A further object of this invention is to provide a system for controlling musical note indicators of a plurality of musical instruments.

An additional object of this invention is to provide a new form of data recording system for recording data representative of musical notes and time values therefor.

Another object of this invention is to provide a playback system for driving note indicators of one or more musical instruments.

These and other objects and features of the present invention will be better understood through a consideration of the following description taken in conjunction with the drawings in which.

Figure 10A:
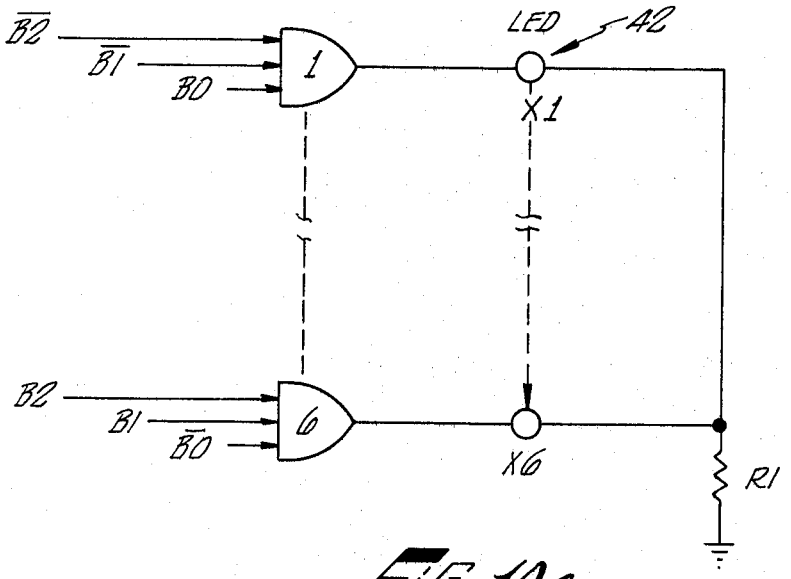
Figure 10B:
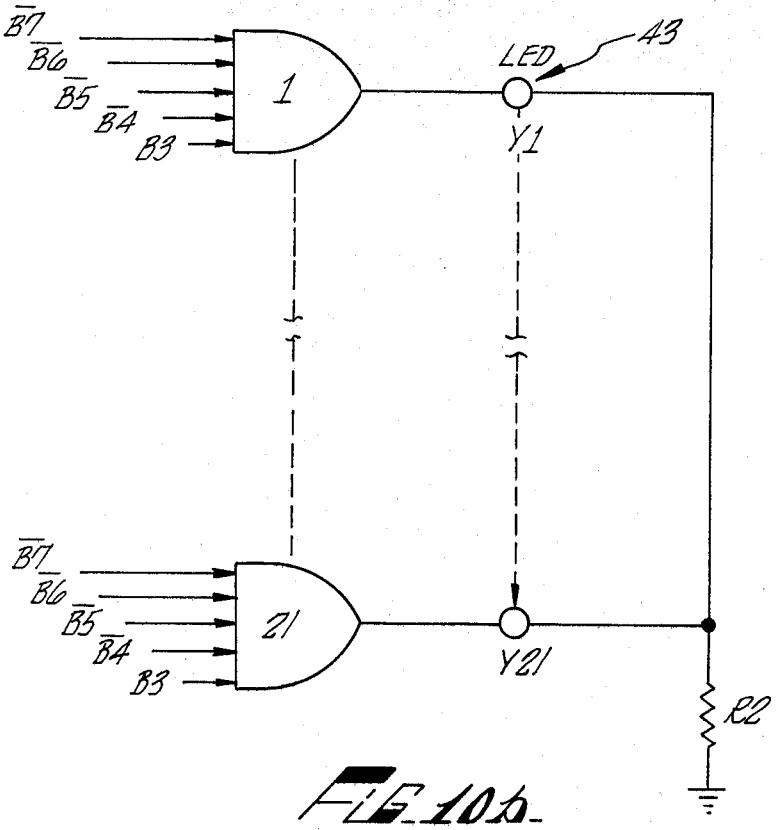
Figure 11:
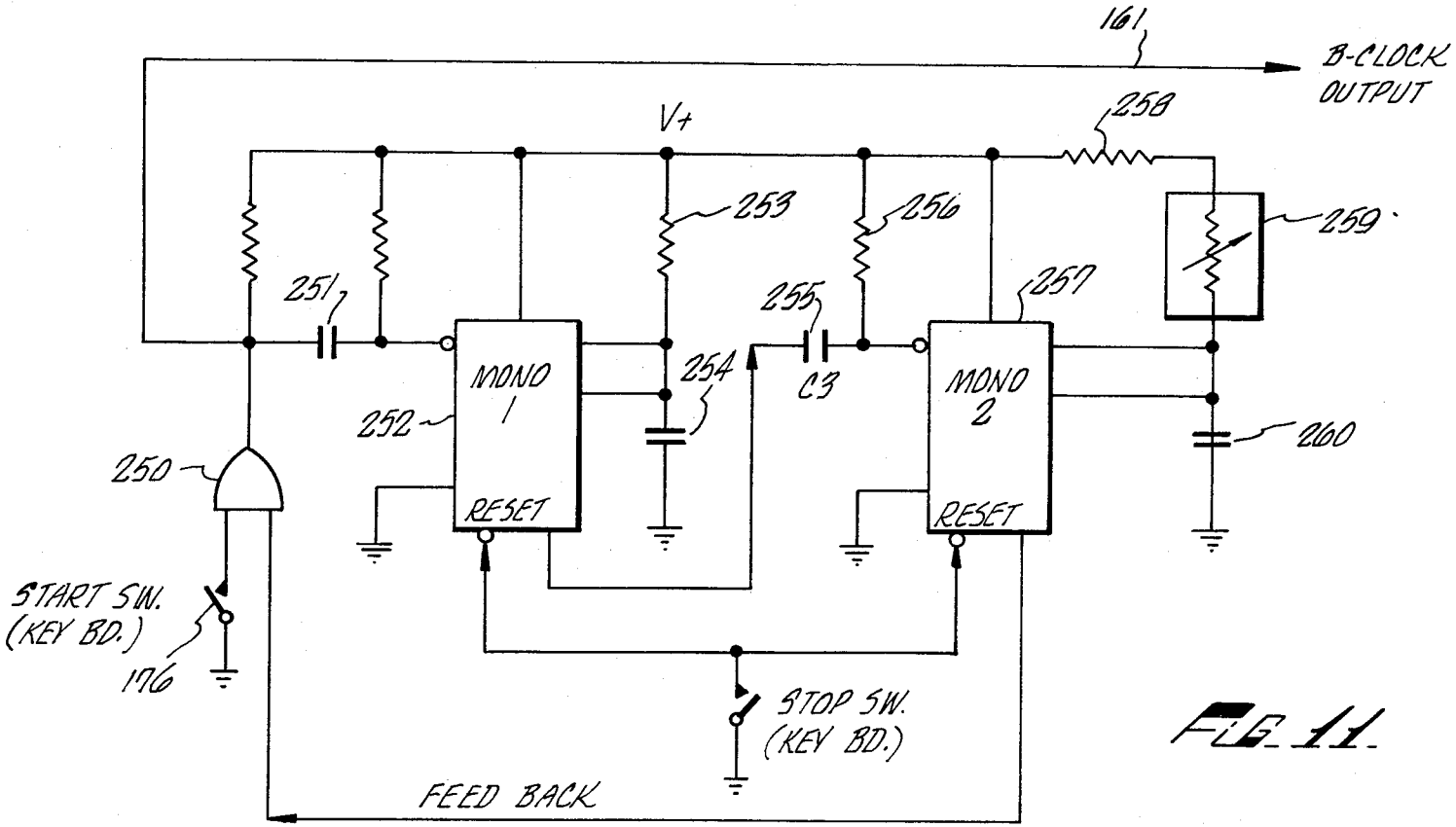

FIGS. 8*a* through 8*e* are diagrams illustrating certain of the data and control pulses used in the system of the present invention;

FIGS. 9*a* through 9*g* illustrate notes of three guitars, the data words and signals, and timing for playing an exemplary series of notes on three guitars;

FIGS. 10*a* and 10*b* are block diagrams illustrating decoders for the X-Y display; and FIG. 11 is a combined block and circuit diagram of a control clock used in the present system.

DETAILED DESCRIPTION

Figure 1:
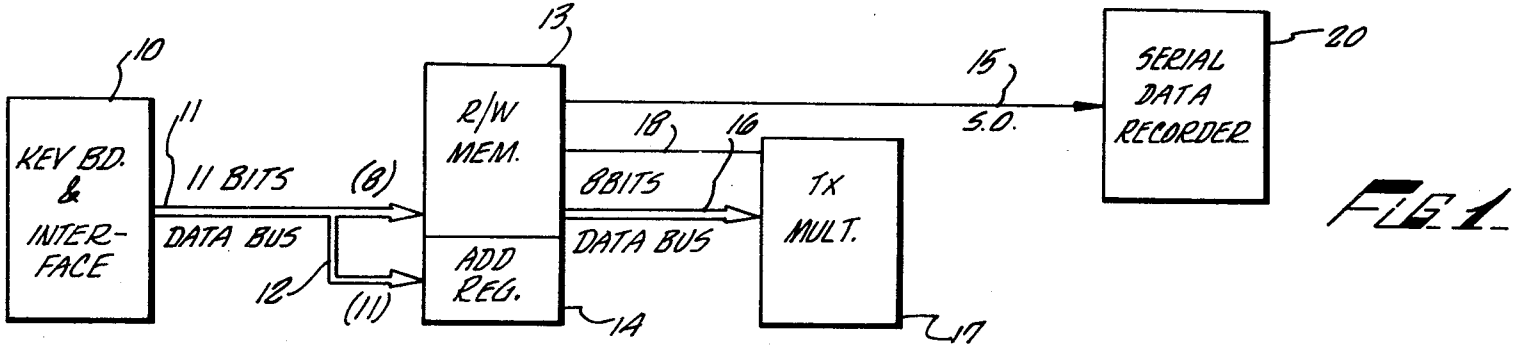
FIG. 1 is a block diagram of a recording system according to the present invention.
Figure 2:
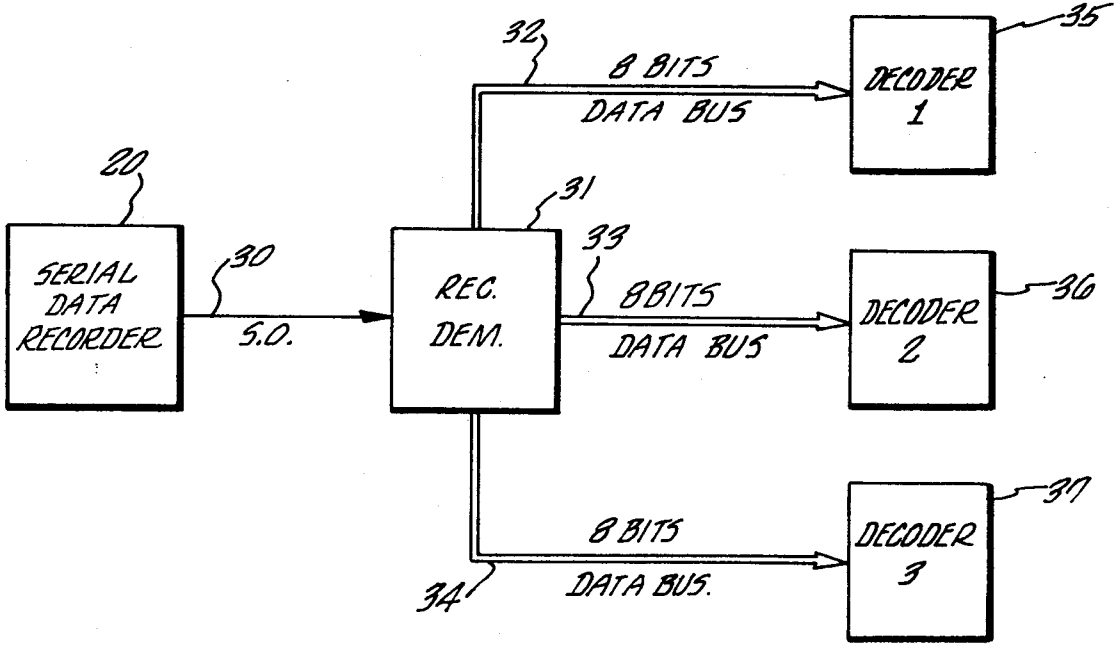
FIG. 2 is a block diagram of an exemplary playback system according to the present invention.
Figure 3:
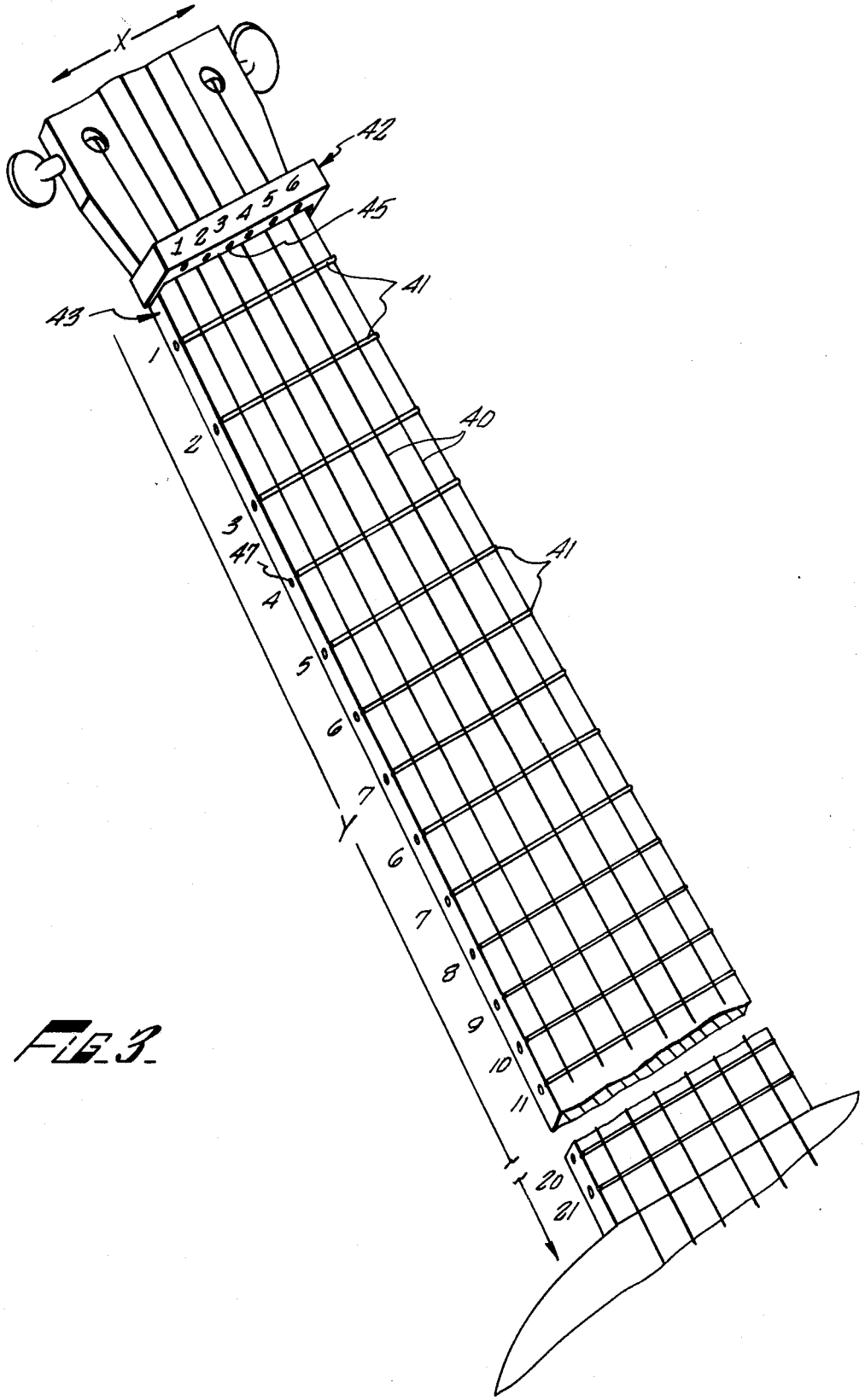
FIG. 3 is a view of a portion of the neck of a guitar illustrating an X-Y display according to the invention for a guitar.

Turning now to the drawings, and particularly FIGS. 1 through 3, a recording system according to the present invention is shown in FIG. 1, and includes a keyboard and interface 10 which communicates through data cables 11 and 12 with a read/write memory 13 and address register 14 for the memory 13. As will appear subsequently, the keyboard may include a plurality of entry keys, for example: numerical entry keys 0 through 7 (see FIG. 4) for entering data in octal form, a start key for initiating operation, a stop key for terminating operation, a clear key for performing a clear operation, a latch key for latching addresses into the address register, and a read/write key for causing data to be entered into or retrieved from the memory. The data word representing the musical note to be displayed may comprise eight bits, and data words typically are entered into successive locations in memory. However, any memory address can be accessed to enable a data word to be read into or read out of any desired memory location.

Figures 8A, 8B, 8C, 8D, 8E, 9A, 9B, 9C, 9D, 9E, 9F, 9G:
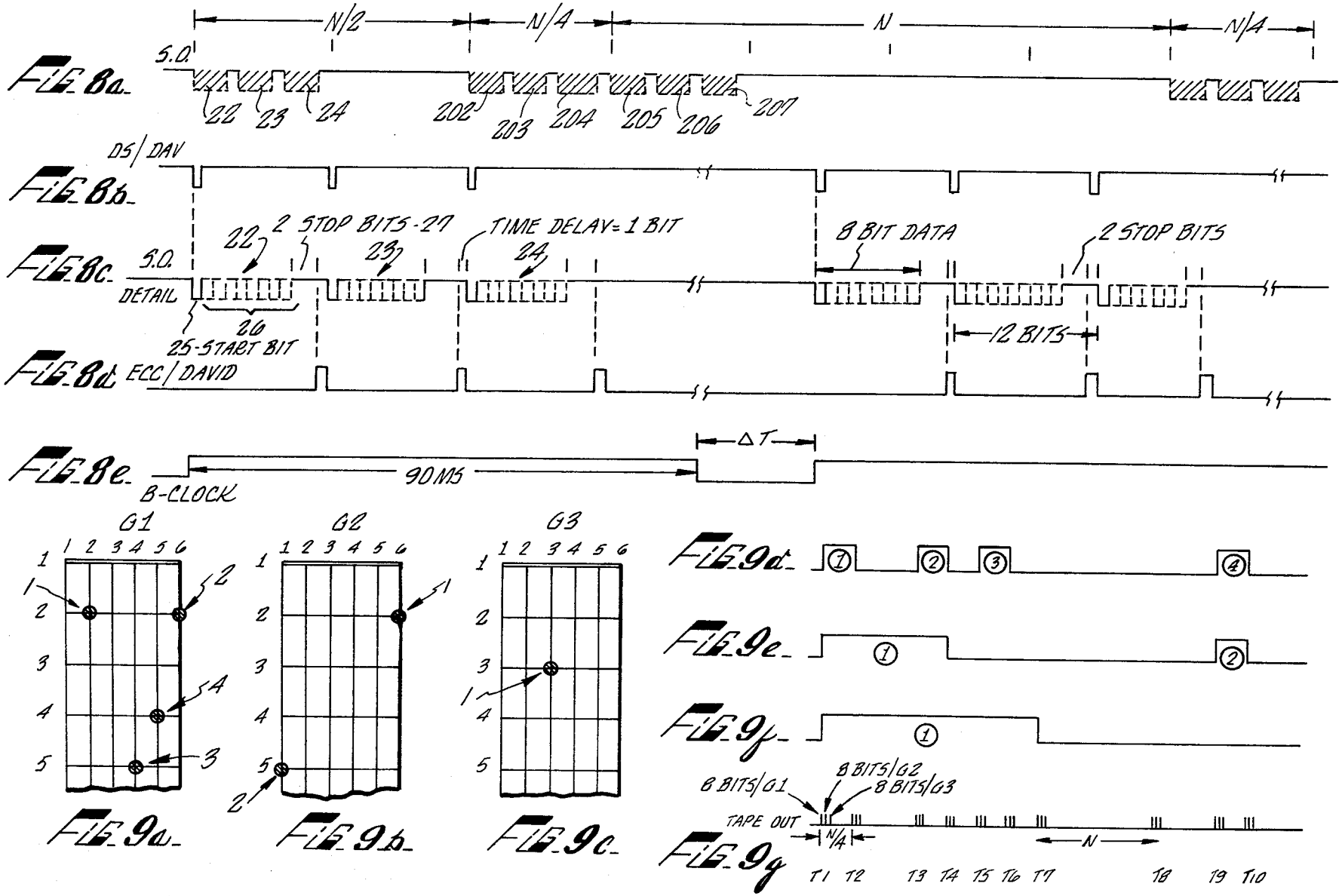

The memory 13 receives data in parallel from the keyboard and interface 10, and shifts this data out in a serial fashion on an output line 15. A portion of the data is supplied by a cable 16 to a transmitter and multiplexer 17 which controls the shift-out of the serial data from the memory 13 by a control line 18. The serial data on line 15 is applied to a serial data recorder 20, which typically is a conventional cassette recorder. The data recorded, as will become more apparent from subsequent discussion of the data words in Table II and the wave form diagram of FIGS. 8*a*–8*e*, comprises a series of bits representing the note to be played and its time value for each of several instruments, with this train being repeated for different notes and time values. Reference may be made to FIG. 8*a* wherein first, second and third groups of data bits 22 through 24 are shown for respective first, second and third guitars. FIG. 8*c* is an expanded version of the data 22 through 24 and illustrates a start bit 25 followed by eight data bits 26 and two stop bits 27. The data, data bits and timing therefor will be discussed in greater detail subsequently.

The cassette recorded on the recorder 20 of FIG. 1 may be replayed by the same recorder 20 of FIG. 2, or a different playback unit may be used. The serial data from the cassette is fed by line 30 to a receiver and demodulator 31 which performs two functions. It converts the serial data back to an eight-bit parallel format and separates the data words for respective instruments. Thus, in a system for three guitars, the receiver and demodulator 31 has three outputs 32 through 34 connected to respective decoders 35 through 37. Each of the outputs 32 through 34 provide an eight-bit data word in parallel to the respective decoders, with output 32 providing a data word for a first guitar, output 33 providing a data word for a second guitar, and output 34 providing a data word for the third guitar. Each 8-bit data word, as noted earlier, represents the particular note to be indicated by the X-Y display. The timing value or time duration of the note (quarter interval, half interval, and so forth) is controlled by the timing of the serial data as will be more fully described in the detailed discussion of the system and study of FIG. 8. The decoders 35 through 37 may be identical, and each serves to drive one light in an X display indicative of which string is to be struck and one light of a Y display indicative of the fret involved, as will be described below, where the displays are associated with guitars.

Turning to FIG. 3, the same illustrates a portion of a guitar neck with strings 40 and frets 41. The X display 42 comprises a series of six lights, preferably of different color, for indicating which string 40 is to be struck. The Y display 43 includes a series of 21 lights to indicate the fret involved. Preferably, the lights are light-emitting diodes. A decoder, such as decoder 35 of FIG. 2, provides output signals to cause one light of the X display 42 to be illuminated and one light of the Y display 43 to be illuminated. In this manner, the particular note to be played is indicated, as will be discussed in greater detail later, and the appropriate lights will be on for a time duration to indicate the appropriate time value of the musical note.

Table I below illustrates the coding used in generating the eight bits of the data word.

TABLE I

| | Y | | | | | X | | | |
|---|---|---|---|---|---|---|---|---|---|
| | B7 | B6 | B5 | B4 | B3 | B2 | B1 | B0 | |
| 1 | 0 | 0 | 0 | 0 | 1 | 0 | 0 | 1 | 1 |
| 2 | 0 | 0 | 0 | 1 | 0 | 0 | 1 | 0 | 2 |
| 3 | 0 | 0 | 0 | 1 | 1 | 0 | 1 | 1* | 3 |
| 4 | *0 | 0 | 1 | 0 | 0 | 1 | 0 | 0 | 4 |
| 5 | 0 | 0 | 1 | 0 | 1 | 1 | 0 | 1 | 5 |
| 6 | 0 | 0 | 1 | 1 | 0 | 1 | 1 | 0 | 6 |
| 7 | 0 | 0 | 1 | 1 | 1 | | | | |
| 8 | 0 | 1 | 0 | 0 | 0 | | | | |
| 9 | 0 | 1 | 0 | 0 | 1 | | | | |
| 10 | 0 | 1 | 0 | 1 | 0 | | | | |
| 11 | 0 | 1 | 0 | 1 | 1 | | | | |
| 12 | 0 | 1 | 1 | 0 | 0 | | | | |
| 13 | 0 | 1 | 1 | 0 | 1 | | | | |
| 14 | 0 | 1 | 1 | 1 | 0 | | | | |
| 15 | 0 | 1 | 1 | 1 | 1 | | | | |
| 16 | 1 | 0 | 0 | 0 | 0 | | | | |
| 17 | 1 | 0 | 0 | 0 | 1 | | | | |
| 18 | 1 | 0 | 0 | 1 | 0 | | | | |
| 19 | 1 | 0 | 0 | 1 | 1 | | | | |
| 20 | 1 | 0 | 1 | 0 | 0 | | | | |
| 21 | 1 | 0 | 1 | 0 | 1 | | | | |

If the third lamp 45 of the X display 42 in FIG. 3 is to be illuminated, the X code is as indicated in the third line with an *, wherein bit B0 is 1, B1 is 1 and B2 is 0. The decimal equivalent is "3." Similarly, if the light 47 for the fourth fret is to be illuminated, the code is as indicated in the fourth line with an *, wherein bit B3 is 0, B4 is 0, B5 is 1, B6 is 0, and B7 is 0. The decimal equivalent for these bits B3-B5 is "4", and for these bits B6-B7 is "0." These codes are the ones used internally in the system, and are generated from the keyboard 10 of FIG. 1 as will be explained subsequently. For example, the code in the third line for the X string light 45 is entered by punching a "3" on the keyboard, and the code in the fourth line for the Y fret light is entered by punching a zero, "0" and "4" on the keyboard (resulting as "0043"), followed by the appropriate write into memory signal.

Table II below illustrates an example of a number of data words representing notes for three guitars G1, G2 and G3 stored in successive memory addresses 1 through 40. Assuming a system for three guitars or other musical instruments, every fourth memory address (No. 4, 8, 12, etc.) stores a time value for the notes. The next three memory addresses then store data words representing the notes for three guitars G1 through G3, again followed by the time value in the next memory address, and so on. Table II shows the memory address, code entered in memory, the guitar (1–3), and the number entered on the keyboard 10 to provide the code for the data words and for the time value data.

TABLE II

| Mem. Add. | Code | Guitar No. & Time | Keybd. No. Entered | |
|---|---|---|---|---|
| | (Set B – CLK = N/8) | | | |
| 1 | 00 010 010 | (G1/N1) | 0022 | |
| 2 | 00 010 110 | (G2/N1) | 0026 | |
| 3 | 00 011 011 | (G3/N1) | 0033 | |
| 4 | 00 000 010 | T1 (Timing) = N/4 | 0002 | T1 |
| 5 | 00 000 000 | (G1/OFF) | 0000 | |

TABLE II-continued

| Mem. Add. | Code | Guitar No. & Time | Keybd. No. Entered | |
|---|---|---|---|---|
| 6 | 00 010 110 | (G2/N1) | 0026 | |
| 7 | 00 011 011 | (G3/N1) | 0033 | |
| 8 | 00 000 011 | T2 = N/2 | 0003 | T2 |
| 9 | 00 010 110 | (G1 = N2) | 0026 | |
| 10 | 00 010 110 | (G2 = N1) | 0026 | |
| 11 | 00 011 011 | (g3 = N1) | 0033 | |
| 12 | 00 000 010 | T3 = N/4 | 0002 | T3 |
| 13 | 00 000 000 | (G1/OFF) | 0000 | |
| 14 | 00 000 000 | (G2/OFF) | 0000 | |
| 15 | 00 011 011 | (G3 = N1) | 0033 | |
| 16 | 00 000 010 | T4 = N/4 | 0002 | T4 |
| 17 | 00 101 100 | (G1 = N3) | 0054 | |
| 18 | 00 000 000 | (G2/OFF) | 0000 | |
| 19 | 00 011 011 | (G3 N1) | 0033 | |
| 20 | 00 000 010 | T5 = N/4 | 0002 | T5 |
| 21 | 00 000 000 | (G1/OFF) | 0000 | |
| 22 | 00 000 000 | (G2/OFF) | 0000 | |
| 23 | 00 011 011 | (G3/N1) | 0033 | |
| 24 | 00 000 010 | (T6 = N/4) | 0002 | T6 |
| 25 | 00 000 000 | (G1/OFF) | 0000 | |
| 26 | 00 000 000 | (G2/OFF) | 0000 | |
| 27 | 00 000 000 | (G3/OFF) | 0000 | |
| 28 | 00 000 100 | T7 = N | 0004 | T7 |
| 29 | 00 000 000 | (G1/OFF) | 0000 | |
| 30 | 00 000 000 | (G2/OFF) | 0000 | |
| 31 | 00 000 000 | (G3/OFF) | 0000 | |
| 32 | 00 000 011 | T8 = N/2 | 0003 | T8 |
| 33 | 00 100 101 | (G1/N4) | 0045 | |
| 34 | 00 101 001 | (G2/N2) | 0051 | |
| 35 | 00 000 000 | (G3/OFF) | 0000 | |
| 36 | 00 000 010 | T9 = N/4 | 0002 | T9 |
| 37 | 00 000 000 | (G1/OFF) | 0000 | |
| 38 | 00 000 000 | (G2/OFF) | 0000 | |
| 39 | 00 000 000 | (G3/OFF) | 0000 | |
| 40 | 00 000 100 | T10 = N | 0004 | T10 |

FIGS. *9a–9c* show the notes N1-N4 to be played on three guitars G1-G3 in accordance with the data words of Table II. FIGS. *9d–9f* diagrammatically illustrate the data word signals for notes 1–4 of the three guitars, and FIG. *9g* illustrates the serial data output train of the cassette tape for the series of data words and with the encoded time values according to Table II. Although groups of data words or bits are shown for the three guitars at each time period T1-T10 in FIG. *9g*, some data words (e.g., those at T7 and T8) will be zero since no note is to be played at certain times.

As noted earlier, any memory address can be accessed to read into or read out of memory a particular note or notes, although in usual practice data words are entered into and retrieved from successive memory addresses. As will be apparent, he data words and time value data words after storage in the serial data recorder 20 of FIG. 1 can be retrieved to indicate the notes to be played by each of the three guitars during each time increment, the shortest time increment typically corresponding with a quarter note or an eighth note. In this manner, data can be stored for programming the playing of three guitars simultaneously in the particular exemplary embodiment shown and described.

Figure 4:
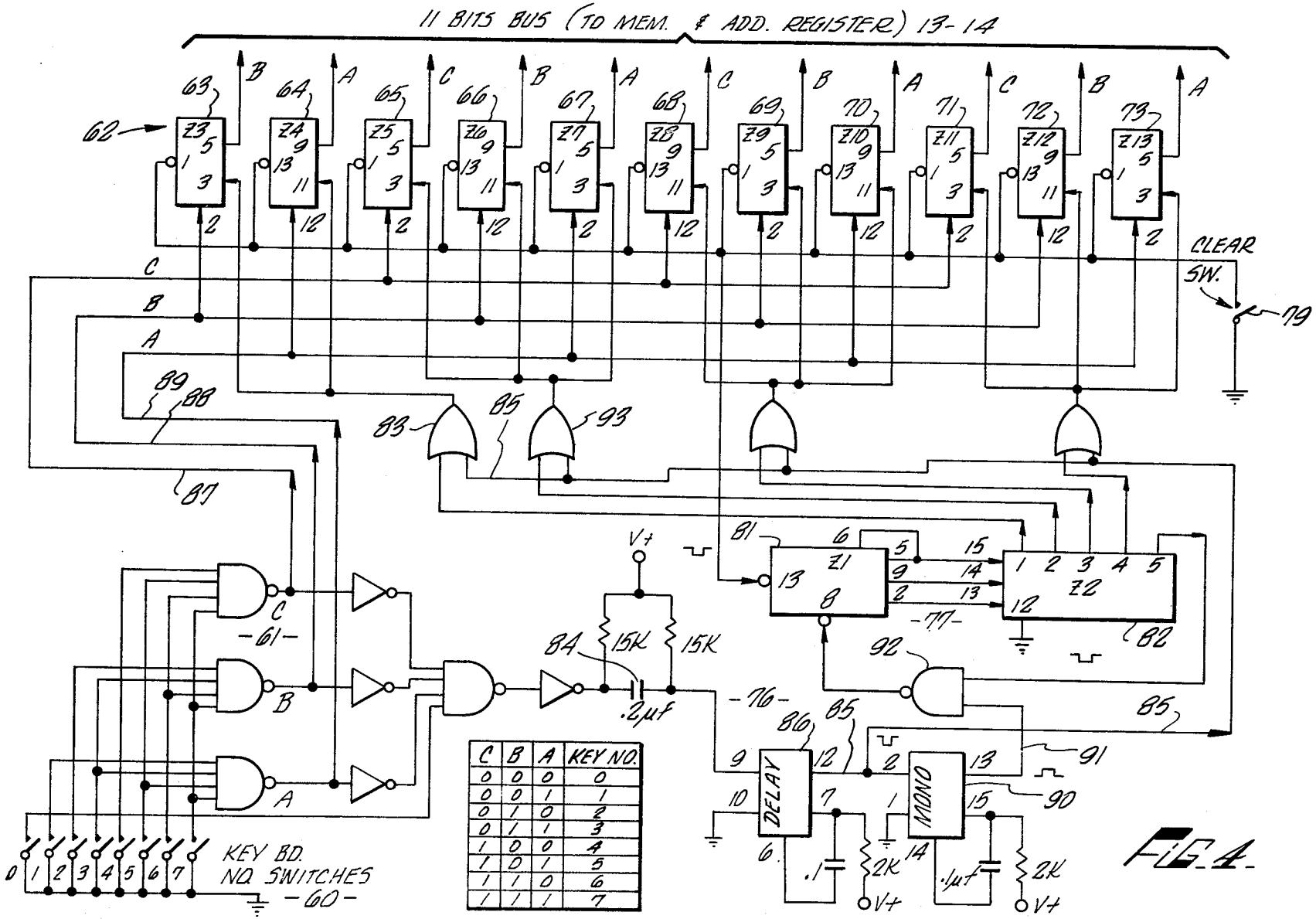
FIG. 4 is a block diagram of a keyboard and keyboard interface used in the recording portion of the present system.

Considering the construction and operation of the exemplary system in greater detail, FIG. 4 is a detailed block diagram of the keyboard and interface 10 of the recorder shown in FIG. 1. This unit includes keyboard number switches 60 shown in the lower left-hand corner of the FIG. 4, and these comprise switches for entry of number 0 through 7. These switches are used to enter the data words. These switches are connected with a logic circuit 61 and with an output register 62 comprising 11 latches 63 through 73 (model SN 7474, Texas Instruments) which provide the output 11 data bits on the bus 11 from the keyboard and interface unit 10 as shown in FIG. 1. The keyboard and interface shown in FIG. 4 also includes a control circuit 76 and counter 77 which function to control the gating of keyboard numbers into the output register 62. Also included on the keyboard is a clear switch 79 shown to the right in FIG. 4 which functions to clear the keyboard unit.

Pushing the clear switch 79 resets the counter 77 which comprises a BCD counter 81 (model S8281) and a decimal counter 82 (model S5442). This operation causes pin number 1 of the decimal counter 82 to go low, while the other pins 2 through 5 are high, to thereby open an output gate 83 to condition latches 63 and 64 for storing A and B data or bits from logic circuit 61 as entered by the keyboard number switches 60. Depressing any one of the 0 through 7 keyboard number switches 60 provides a signal from the logic circuit 61 to charge a capacitor 84 of the control circuit 76 thereby causing an output pulse on a line 85 from a delay circuit 86. This output pulse on the line 85 passes through the open gate 83 to cause data on lines 88 and 89 from the keyboard logic 61 to be latched into conditioned latches 63 and 64, respectively, of output register 62. Then, a monostable flip-flop 90 of the control circuit 76 receives the positive going edge of the delayed pulse on line 85 which triggers the circuit 90 to generate an output pulse on a line 91 and through a gate 92 to increment the BCD counter 81 and the decimal counter 82 by one. This causes pin number 1 of counter 82 to return to the high state and pin number 2 to go low thereby closing output gate 83 and opening otuput gate 93. When gate 93 opens it conditions the next series of latches 65 through 67 of the output register 62 to receive the next data word. The counter 77 continues counting each time a keyboard number is switched until pin number 5 of the decimal counter 82 goes low which causes the gate 92 to close. When the gate 92 closes, the counter 77 stops counting or shifting even though other keyboard number switches are pushed, and at this time the data entered by the keyboard switches 60 is stored in the output register 62 and ready to be written into the address register 14 (FIGS. 1 and 5) and stored in the memory 13. Whenever the clear switch 79 is again pushed, the output register 62 is cleared, as is the counter 77, thereby allowing the entry of new data by the keyboard switches 60.

Figure 5:
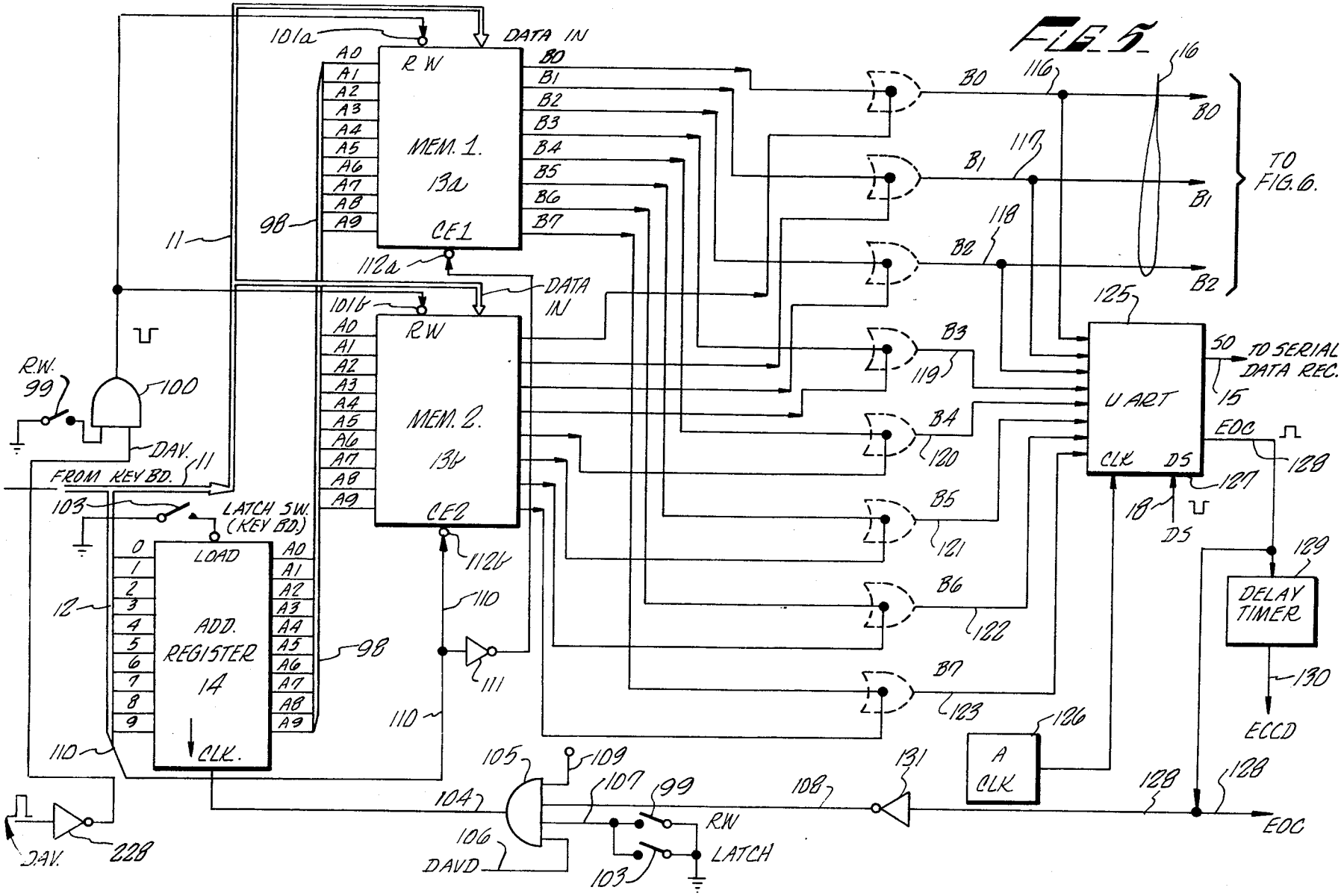
FIG. 5 is a block diagram of a read/write memory and address register of the system of the present invention.

The data from the output register 62 of the keyboard and interface 10 shown in FIG. 4 and described above is supplied to the memory 13 and address register 14 which are shown in greater detail in FIG. 5. The data cable 11 is shown entering the circuit on the left-hand side of FIG. 5 and is connected to a first memory section **13*a* and a second memory section 13*b*, such as Intel 2102. Each of these memory sections comprises a memory having a capacity of 1048 data words. The 8-bit data words are supplied by the cable 11 to the two memories 13*a*–13*b*. In a similar manner, all of the 11 bits of data from the output register 62 are supplied by the cable 11 and cable 12 to the memory address register 14. The memory address register 14 (model S8281) is, in turn, connected by a cable 98 to appropriately address memory locations in the memories 13*a*–13*b* in a conventional manner. In the typical operation, data words are entered into successive addresses or locations in the first memory 13*a* and when this memory is full then data is similarly entered into the second memory 13*b*. However, any memory address can be accessed through the keyboard and interface 10 and the address register 14** to thereby enable a data word from any memory address to be changed or altered, or read out, as desired. For example, it may be desirable to correct a given data word to thereby correct or change a musical note previously entered into memory.

The memory 13a–13b thus receives data in parallel from the keyboard and interface 10 through the data cable 11. Data is entered into an address in one of the memories 13a–13b by depressing a read/write switch 99 connected with a gate 100, the output of which is connected to a read/write input terminal 101a and 101b of the memories 13a and 13b. An address is entered into the address register 14 by depressing a latch switch 103 connected with a load input of the address register 14. Both of the switches 99 and 103 are located on the entry keyboard. The address register 14 includes a clock input 104 to increment the address register 14 in a conventional manner. A gate 105 is connected to the clock input 104 and receives a signal on any one of input lines 106 through 109, any one of which will increment the register 14. The eleventh bit of the data on input cable 12 to the address register 14 provides a memory select signal on a line 110 through an inverter 111 to an enable input 112a of the first memory 13a to enable this memory when any one of addresses 0 through 1024 are selected. Similarly, a signal on the line 110 to enable input 112b of memory 13b selects this second memory when addresses 1025 through 2048 are selected.

As will be apparent to those skilled in the art, the 8-bit data words are stored in various locations in the memories 13a–13b and can be read out sequentially, or in any other addressed order, in parallel as bits B0 through B7 on output lines 116 through 123. The outputs of the memories 13a and 13b are OR'ed together to provide the ouputs on lines 116 through 123. These output lines are connected to a conventional universal asynchronous receiver and transmitter available from Signetics or Texas Instruments, referred to herein as a UART. This circuit 125 receives the eight data bits in parallel and transmits the same out in serial fashion upon command on an output line 15. The output line 15, as was noted earlier, is connected to the serial data recorder 20 of FIG. 1 to record the serial data on a storage medium such as a cassette tape. The UART circuit 125 has a clock input to which clock signals are supplied by a system A clock 126 (for example, 6.4 K hz), a data shift (DS) input 127 to which control input line 18 is connected and an output line 128 which provides an end of character (EOC) output pulse. The end of character line 128 is connected through a delay timer 129 to an output line 130 to provide a delayed end of character signal EOCD for purposes which will be explained later, and the line 128 is connected through an inverter 131 and the line 108 as an input to the address register increment gate 105 to increment the address register at the end of each character transmitted by the UART circuit 125.

Figure 6:
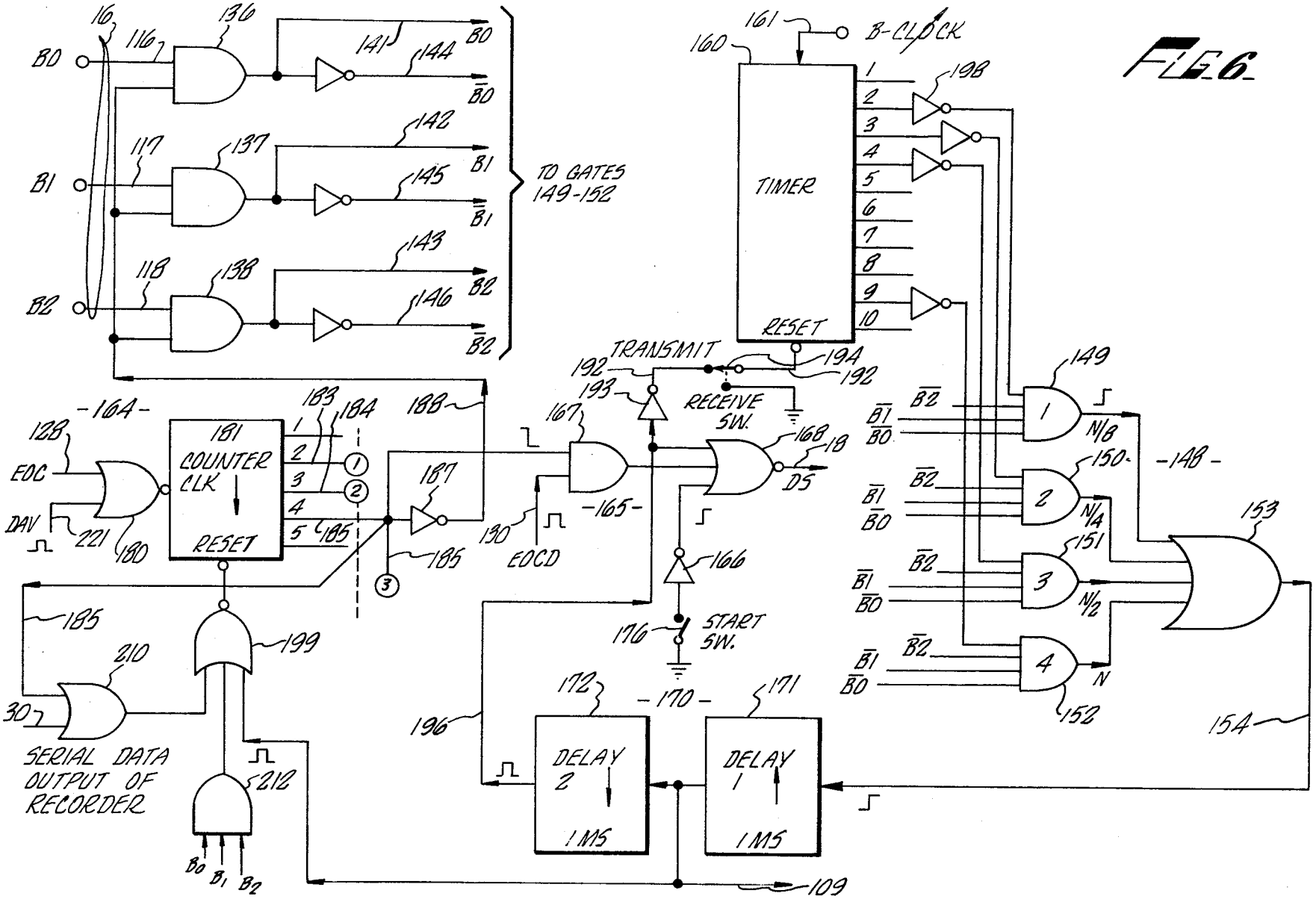
FIG. 6 is a block diagram of a transmitter and multiplexer portion of the system of the present invention.

Three of the data bits B0, B1 and B2, on the respective lines 116 through 118 from the memories 13a–13b, are connected through cable 16 to respective gates 136 through 138 of the transmitter and multiplexer 17 shown in detail in FIG. 6. The outputs of the gates 136 through 138 provide the bits B0 through B2 on respective lines 141 through 143 as well as the inverted form of these bits on respective lines 144 through 146. These output lines are connected as inputs to a set of time value gates 148 comprising and gates 149 through 152 having outputs connected with an OR gate 153. The bits B0 through B2 designate the time value of a given note and depending upon the bits present, they open one of gates 149 through 152 to provide a note time value output on line 154 from the output OR gate 153. The gate 149 is for an eighth interval note, the gate 150 for a quarter interval note, the gate 151 for a half interval note, and the gate 152 for a full interval, or whole, note. A B timer 160 having a B clock (variable) input 161 has output pins 2, 3, 4 and 9 connected through inverters to inputs of the respective gates 149 through 152. The timer 160 serves as a counter to provide the proper time values for the notes. The transmitter and multiplexer of FIG. 6 also includes a counting circuit 164 on the left-hand side of FIG. 6, a control circuit 165 comprising gates 166, 167 and 168, and a delay circuit 170 comprising delay units 171 and 172 (model SN 74123), the operation of which will be described shortly.

The transmitter and multiplex circuit of FIG. 6 controls the shifting of serial data from the UART circuit 125 to the output line 15 (FIG. 5). After all the desired data words have been written into the memories 13a–13b, these data words can be transmitted to the serial data recorder 20 (FIG. 1) by depressing a start switch 176 shown in the middle of FIG. 6 connected to the inverter gate 166 on the input of nor gate 168. Typically, the start switch 167 is a button on the keyboard of the keyboard and interface unit 10. The start switch 176 supplies ground to the input of the inverter 166, and the output of this inverter goes high to cause an output from the nor gate 168 on the output line 18. This signal is labeled DS and is supplied to the input terminal 127 of the UART circuit 125 in FIG. 5. The UART circuit 125 then shifts out the serial data on output line 15 at a speed that is controlled by the A clock 126 connected to the UART circuit 125. Thus, when a logic low signal is applied at the DS input 127 of the UART circuit 125, serial transmission begins (as shown in FIGS. 8a and 8c).

Referring for the moment to FIG. 8c, the serial output from the UART circuit 125 has a first (start) bit 25 which is low, and the second through ninth bits 22 represent the 8-bit data word. The last two bits 27 are a logic high and represent two stop bits. Thus, one character from the serial output 15 of the UART circuit 125 comprises 11 bits. At the end of the eleventh bit, the UART circuit will generate an end of character, EOC, signal on its output line 128. The EOC signal is inverted from high to low logic by inverter 131 of FIG. 5, which in turn provides a signal through line 108 and increment gate 105 to increment the memory address register 14. This causes the data in the next address location to be ready for transmission. The EOC signal on output line 128 of the UART circuit 125 also is supplied to the delay timer 129 which provides a delay of approximately one data bit, or approximately 2.5 milliseconds, to ensure that the memories 13a–13b and address register 14 have sufficient time to increment and be prepared to transmit the next data word.

The delayed end of character signal, EOCD, on output line 130 of delay timer 129 of FIG. 5 goes high after passing through the delay timer 129 and is supplied by the line 130 as one input of and gate 167 of the transmitter and multiplex circuit and shown in the middle of FIG. 6. The output of the and gate 167 is connected as an input to the nor gate 168 which provides a logic low signal, which is the DS signal on the output line 18 and which goes to the DS input 127 of the UART circuit 125 to cause the second character to be transmitted. The described cycle is repeated, followed by transmission of the third character. It should again be noted that the first serial character represents the musical note for a first instrument, the second character represents a note for the second instrument, and the third character represents a note for the third instrument.

Considering the counting circuit 164 of the transmitter and multiplex circuit of FIG. 6 further, normally this counter is in a reset condition wherein output pin 1 is at a logic low and the rest of the output pins 2 through 4 are at a logic high. When the first end of character signal, EOC, is transmitted from output 128 of the UART circuit 125 of FIG. 5, the same is supplied through nor gate 180 of the counting circuit 164 to the counter 181 (model S8281 and S5442) thereof. The counter 181 counts one which causes pin number 2 and line 183 to go to logic low. When the counter 181 receives the second EOC, the counter counts to two, thereby causing its output pin 3 and line 184 to go to logic low, with the rest of the output pins in each case being high. The third EOC signal causes counter output pin 4 and line 185 to go low, and this output signal is inverted by an inverter 187 to high and supplied on a line 188 to open all of the gates 136 through 138 to thereby pass bits B0 through B2 from the memory 13*a*–13*b* to the time value gates 148. The B0-B2 data on lines 141 through 146 cause one of the time value gates 149 through 152 to open as will be explained in greater detail subsequently. The outputs from pins 2 through 4 of counter 181 on lines 183 through 185 are applied to registers in the playback circuit of FIG. 7, as will be described in greater detail subsequently, to appropriately gate data words to the respective three instruments.

Turning again to the timer 160 of FIG. 6, this circuit functions as a counter and is reset by a signal on a line 192 from an inverter 193 whenever a transmit/receive switch 194 is in the transmit position as shown in FIG. 6. Typically, the minimum time the timer 160 counts is approximately 90 milliseconds, and this time duration is selected to be sufficiently long for the UART circuit 125 to transmit three data characters in series, including the start and stop bits of each character and the time of the delay timer 129. In a typical example, this totals thirty-five bits, wherein each bit is equal to 2.5 milliseconds, thereby giving a total required time of 87.5 milliseconds. The timer 160 may be a conventional circuit identified as model number 555 or SN74123 (Texas Instruments). The clock signal supplied to input terminal 161 preferably can be varied from approximately ninety milliseconds up to approximately two hundred milliseconds to allow control over the output of the timer 160. The timer 160 is reset at its input 192 every cycle from the signal on line 154 from the output OR gate 153 of the time value gate circuit 148 through the delay circuit 170 and inverter 193. As can be seen from FIG. 6, the output of the OR gate 153 is connected by line 154 to the input of the first delay circuit 171, the output of which is connected through a second delay circuit 172 to an output line 196 which, in turn, is connected to the inverter 193 to reset the timer 160. The delay provided by each of the delay circuits 171 and 172 preferably is approximately one millisecond. By setting the clock signal supplied to clock input 161 of the timer 160 to correspond to an eighth note time value, then the timer 160 provides outputs at one-eighth intervals so as to enable note time values of an eighth, quarter, half and whole notes to be readily obtained. Assuming an eighth note time value is desired, the first gate 149 is opened by bit B0 being high, and bits B1 and B2 being low. As the timer 160 counts, it counts an eighth note interval thereby causing its output pin 2 to go low and the remainder of the output pins to be high. This logic low is inverted by an inverter 198 to logic high to gate the and gate 149. The output logic high from the and gate 149 passes through or gate 153 and triggers the input of the first delay circuit 171. After a delay of approximately one millisecond, the output of the delay circuit 171 passes through a nor gate 199 and is inverted to reset the counter 181 after it counts three EOC pulses. This represents the completion of the whole cycle of transmitting three characters in serial from the UART circuit 125 of FIG. 5. The high signal from the output of the delay circuit 171 also is fed to the delay circuit 172 which provides another one millisecond delay and, in turn, provides a high output signal through nor gate 168 which inverts the signal to low and provides the DS output signal on output line 18 to the shift input 127 of the UART circuit 125 (FIG. 5) to start a new cycle of transmitting. At this time, the output of the second delay circuit 172 supplies a signal through the inverter 193 to reset the timer 160. Quarter notes, half notes and whole notes are selected in the same manner, except in this case, one of the gates 150 through 152 is opened by the bits B0-B2.

Thus, it will be seen that three data words or characters are shifted out in serial fashion from the UART circuit 125 respectively representing notes for the three musical instruments, and this cycle is continually repeated. The time value for the three notes is determined by which one of the time value gates 149 through 152 is opened which, in turn, gates out at a time as controlled from the output of the timer 160. In other words, the or gate 153 provides an output after a one-eighth note interval if the top and gate 149 is enabled by the bits B0-B2, the gate 153 provides an output at a later time if the quarter note gate 150 is enabled by the bits B0-B2, and so forth. Reference should be made to FIG. 8*a* wherein three data words 22 through 24 are shown being shifted out in serial fashion and with a time value of N/2 representing a half note. Then, three data words 202 through 204 for the three instruments are shown being shifted out but with quarter note value, N/4. Next, three data words 205 through 207 having a time value of a whole note are shown. In the case of the data words 22 through 24, the half note gate 151 was enabled, in the case of the data words 202 through 204, the quarter note and gate 150 was enabled, and in the case of the data words 205 through 207, the whole note and gate 152 was enabled. The inputs of the time value gates 149 through 152 are connected with respective ones of the lines 141 through 146 as indicated by the bit designations on the input lines to these gates.

The transmitter and multiplex circuit of FIG. 6 includes a nor gate 210 having line 185 representing the third count from the counter 181 connected as an input thereto and having a line 30 connected as another input thereto for supplying the serial data output of the cassette recorder 20 (FIG. 2) for use in the playback mode as will be described later. Additionally, an and gate 212 which receives the bits B0-B2 has an output connected to the nor gate 199 to reset the counter 181 when all three of these bits are true.

Figure 7:
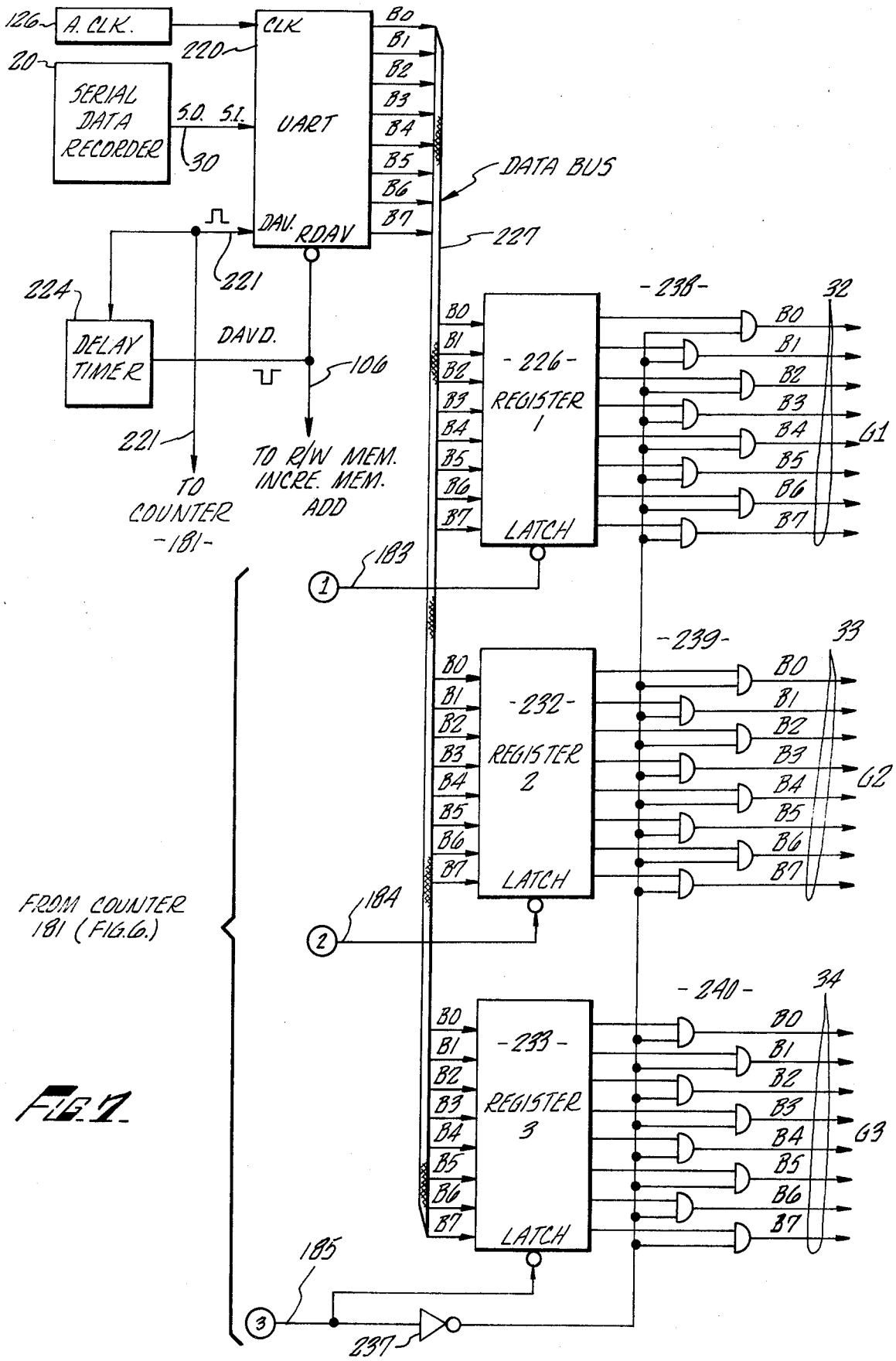
FIG. 7 is a block diagram of a receiver and demodulator used in the playback portion of the system of the present invention.

Turning now to playback of the recorded data, reference may be made to FIG. 7 which shows the receiver and demodulator 31 of FIG. 2 in greater detail. As noted earlier, the serial data recorder 20 may be any conventional recorder, such as a cassette recorder. A stereo recorder may be used, in which case one channel is used for recording the data as described herein and the other channel is used to record music corresponding with the data recorded by the present system. This will facilitate learning to play a musical instrument or a particular song. The serial output data from the data recorder or playback unit 20 in FIG. 7 is supplied to a serial input of another UART circuit 220 like the earlier described UART circuit. The circuit 220 changes the serial data back to parallel data wherein the data word comprises eight bits in parallel, and the parallel data is shifted out under control of the A clock 126. The circuit 220 looks for the logic low of the start bit 25 (FIG. 8*c*) and then shifts out the eight parallel bits. The first and second stop bits 27 of the data word indicate to the circuit 220 the end of character. This causes the circuit 220 to generate a data available, DAV, signal on an output line 221. This is a positive going signal which is applied by the line 221 to the input of nor gate 180 of the counting circuit 164 of the transmitter and multiplex circuit in FIG. 6. This signal causes the counter 181 of the counting circuit 164 to increment by one with each DAV signal. Assuming, for example, that the counter 181 was in a reset state, then its output pin 1 is low and its output pins 2 through 4 are high. When the first DAV signal is received on line 221, the counter 181 counts one thereby causing pin number 2 and output line 183 to be low and the remainder of the output pins to be high. This logic low from pin number 2 on output line 183 is connected to the latch input of a first register 226 of the receiver and demodulator circuit of FIG. 7. The DAV signal on the line 221 from the UART circuit 220 also is applied through a delay timer 224 to provide a delayed DAV signal, DAVD, which is used to reset the UART circuit 220. The delay of the timer 220 can be approximately one-half millisecond so as to provide enough time for the counter 181 to count (and the memories to write data for purposes which will be explained later) before resetting circuit 220. After the circuit 220 is reset, it is ready to receive and transmit the next data word. When the data on input line 30 to the circuit 220 goes low the first time after the circuit 220 has been reset (when the next start bit 25 occurs), the circuit 220 will convert the following 8-bit serial data to 8-bit parallel data, and at the end of this data word the circuit 220 again generates the DAV signal on output line 221. This second DAV signal causes the counter 181 (FIG. 6) to increment, which in turn provides an output from the third pin on line 184 to cause the second register 232 (FIG. 7) to latch the next 8-bit parallel data on data bus 227. This cycle is repeated to cause the third data word to be latched into register 233. The registers 226, 232 and 233 may be conventional register models S8281 and each holds its respective data word for the respective three musical instruments until a new data word is entered.

When the UART circuit 220 generates the third DAV signal on output line 221 representing the end of the third data word, the counter 181 of the transmitter and multiplex circuit of FIG. 6 counts to three and its pin number 4 provides a logic low output on output line 185. This causes the third register 233 to latch as noted above, and at the same time this signal on line 185 is inverted by a gate 237 which provides a high signal to open all of the output and gates 238, 239 and 240 on the outputs of the respective registers 226, 232 and 233. This action gates out all of the data words to the output cables 32, 33 and 34 to the display decoders 35 through 37 (FIG. 2), the details of which will be described later.

During playback, the B timer 160 of the transmitter and multiplex circuit is not used, and FIG. 7 and the counting circuit 164 (comprising gates 180, 199, 210 and counter 181) of FIG. 6 are used.

As an alternative, the memories of FIG. 5 may be used during playback to allow the 8-bit data words from the data cable 227 of the receiver and demodulator in FIG. 7 to be gated back into the memories of FIG. 5 so as to enable the data words to be replayed at a different speed. In this case, each DAV signal from output line 221 of the UART circuit 220 in the receiver and demodulator of FIG. 7 is fed to an inverter 228 in the lower left-hand corner of the read/write memory circuit of FIG. 5, and is inverted and fed to the input of the and gate 100 to provide a read signal for the inputs of the memories 13*a*–13*b*. This enables the parallel 8-bit data words to be shifted (through a switch, not shown) from the data cable 227 of the receiver and demodulator of FIG. 7 back into the memories. Similarly, the delayed DAV signal, DAVD, from the output of the delay timer 224 of the receiver and demodulator of FIG. 7 is supplied by a line 106 to the increment gate 105 of the address register 14 to increment the memories by one. After these data words are reentered into the memories 13*a*–13*b*, they may be read out at a different speed by varying the rate of the B clock pulses applied to clock input 161 of the timer 160 of the transmitter and multiplex circuit of FIG. 6 to cause the serial output from the UART circuit 125 of the read/write memory circuit of FIG. 5 to occur at a different rate. This serial output then can be applied to the UART circuit 220 of the receiver and demodulator so as to provide the parallel data words out at the new selected rate. This is useful in teaching, for example, wherein the data words operate the lamp displays at a slower than normal rate.

As noted earlier, FIG. 8*a* illustrates the serial output data applied to the serial data recorder 20 or derived from the recorder. FIGS. 8*b*–8*e* are on an expanded scale and, thus, FIG. 8*c* is an enlarged version of the data in FIG. 8*a* and shows the start bits, eight bits of the data words and the stop bits for each note for each instrument. FIG. 8*b* illustrates the DS output pulses from the transmitter and multiplex circuit of FIG. 6 which are applied to the DS input 127 of the UART circuit 125 of the read/write memory circuit FIG. 5 in the recording mode, and also shows the DAV pulses supplied on output line 221 of the UART circuit 220 in the receiver and demodulator circuit of FIG. 7 which are used for incrementing the counting circuit 164. FIG. 8*d* illustrates the end of character, EOC, pulses applied on output line 128 of the UART circuit 125 in the read/write memory circuit of FIG. 5, as well as the delayed DAV pulses, DAVD, from the delay timer 224 connected at the DAV output of the UART circuit 220 of the receiver and demodulator of FIG. 7. FIG. 8*e* illustrates typical B clock pulses applied at clock input 161 of the timer 160 of the transmitter and multiplex circuit of FIG. 6. The A clock pulses (not shown) provides sixteen cycles per bit.

As explained previously, the 8-bit data words received serially from the recorder 20 are converted to parallel and latched into the respective registers 226, 232 and 233 of the receiver demodulator circuit of FIG. 7. When the counter 181 of the transmitter multiplex circuit (which counter is used in the playback system) reaches its count of three, these 8-bit data words for three respective musical instruments are gated out by the output gates 238 through 240 to the output data busses 32 through 34. These data busses are connected to a plurality of and gates forming the decoders of FIGS. 10*a* and 10*b*. It will be apparent to those skilled in the art that the and gates of FIGS. 10*a*–10*b* merely function to decode the binary bits for bits Bo-B7 to light one of the LED sources in the X display 42 of FIG. 10*a* and one of the LED sources in the Y display 43 of FIG. 10*b*. The decoding is consistent with the encoding as shown in Table I. As shown in the playback block diagram of FIG. 2, three of the decoders as shown in FIGS. 10*a*–10*b* are used where three guitars and their displays are involved. It will be apparent that the data bits Bo-B7 from cable 32 of FIG. 7 are connected to one decoder as shown in FIGS. 10*a*–10*b* to operate the X-Y display of the first guitar, and in a similar manner the data on cables 33 and 34 of FIG. 7 are connected to respective decoders as shown in FIGS. 10*a*–10*b* to operate the displays of the second and third guitars. The system is operable with a single guitar, with two guitars simultaneously, or with three guitars simultaneously. Likewise, more instruments can be used by merely expanding this system as previously described and illustrated. The time of display depends upon the time value of the notes involved. The LED displays 42 and 43 are controlled by the third count of the counter 181 of the counting circuit 164 in the transmitter multiplex circuit of FIG. 6 inasmuch as this count serves to gate the data words from the registers 226, 232 and 233 to the decoders. The displays 42 and 43 are turned off after reset of the counter 181 of the counting circuit 164 since reset of the counter makes its pin number 4 go high and this signal is inverted by the inverter 237 in the receiver and demodulator of FIG. 7, the output of which closes or turns off the gates 238 through 240. However, if a note is to be continued to be played, the appropriate display lamp will be turned on again rapidly.

Considering the resetting of the counter 181 of the counting circuit in the transmitter and multiplex circuit of FIG. 6 further, at the count of three, a low signal is applied by line 185 to the input of or gate 210, and the other input 30 of the gate 210 will be high because after the counter 181 receives the DAV signal from the UART circuit 220 in the receiver and demodulator circuit of FIG. 7, the serial output from the serial data recorder 20 is high (during the stop bits 27). The UART circuit 220 then looks for the first low signal (the next start bit 25) to send out the next 8-bit data word in parallel. When the stop bits 27 at the end of the serial data word occur, and after the third data word (e.g., 24 in FIG. 8*c*) is converted from serial to parallel form, the counter 181 is at a count of three. This provides a low signal on line 185 to the input of the nor gate 210, and upon receipt of the start bit (low) 25 of the next serial character (for the first instrument), the output of the gate 210 causes the counter 181 to be reset. The display lights are turned off, but subsequently are turned on again within about ninety milliseconds during the next cycle if the same note is to be continued or a new note is to be played.

FIG. 11 is a combined block and circuit diagram of the B clock which supplies clock pulses to clock input 161 of timer 160 of the transmitter and multiplex circuit of FIG. 6. When the start switch 176 (preferably on the keyboard) is depressed, an and gate 250 passes a logic low signal to its output and through a capacitor 251 to the input of a first monostable multivibrator 252. A resistor 253 and a capacitor 254 comprises the RC time constant network therefor, providing approximately a ninety-millisecond time constant. The output of the multivibrator 252 is fed to a differentiating network comprising a capacitor 255 and a resistor 256, and this network provides a negative going pulse to trigger a second monostable multivibrator 257. The time constant network of the multivibrator 257 comprises a resistor 258, variable resistor 259 and a capacitor 260. The timing from this network can be varied from one millisecond to one hundred ten milliseconds, and the output of the multivibrator 257 is fed back to the input of the gate 250 in a conventional closed loop fashion. The output of the gate 250 provides the clock pulses on line 161 to the clock input of the timer 160 of the transmitter and multiplex circuit of FIG. 6.

While embodiments and applications of this invention have been shown and described, it will be apparent to those skilled in the art that modifications are possible without departing from the inventive concepts herein described.

What is claimed is:

1. An electronic system for driving a two-dimensional display for a musical instrument, such as a guitar or the like, comprising display means having first and second series of light sources, said first series being comprised of one light for each string on said guitar, and being disposed at the neck of said guitar, and said series comprising one light source for each fret of said guitar, and being disposed along the top edge of the neck of said guitar, wherein illumination of one light source of each of said first and second series identifies by string and fret a musical note to be played on said instrument, means for receiving a stored data word sequence representing musical notes to be played, demodulator means for reading out said data words in parallel, and decoder means for receiving said data words in parallel and for operating one light in each of said first and second series of lights in response to each parallel data word.

2. An electronic system for driving a two-dimensional display for a musical instrument, such as a guitar or the like, comprising display means having first and second series of light sources forming an X-Y display and wherein illumination of one light source of each series identifies a musical note to be played on an instrument with which the display means is directly associated, the first of said series of light sources being adapted to be associated with the strings of a guitar, with each light source of the first series being associated with a respective string, and the second series of light sources comprising a plurality of light sources respectively being adapted to be associated with the frets of the guitar, means for receiving a stored data word sequence representing musical notes to be played, a portion of said sequence representing the time intervals of said musical notes and demodulator means for reading out said data words in parallel, and decoder means for receiving said data words in parallel and for operating one light source of each series of light sources in response to each parallel data word for the time interval determined by said portion of said sequence.

3. An electronic system for driving a two-dimensional display for musical instruments, such as guitars or the like, comprising display means having first and second series of light sources forming an X-Y display and wherein illumination of one light source of each series identifies a musical note to be played on an instrument with which the display means is directly associated, said display means comprising a plural number G of X-Y displays for respective instruments, means for receiving a stored data word sequence representing musical notes to be played, a portion of said stored sequence representing the time intervals for which said notes are to be played, and demodulator means comprising a plurality of storage registers, and said data word sequence representing notes to be played on a respective plural number G of musical instruments, decoder means for receiving said data words in parallel and for operating one light source of each series of light sources in response to each parallel data word for the interval represented by said portion of said sequence and counting means connected with said demodulator means for gating data words for notes to be played on respective instruments to respective ones of said storage registers to thereby cause appropriate light sources in the X-Y displays of the instruments to operate simultaneously for facilitating the playing of the musical instruments simultaneously.

4. An electronic system for driving displays for musical instruments, such as guitars or the like, comprising a plurality of display means each having light sources forming a display and wherein illumination of a light source identifies a musical note to be played on a musical instrument with which a respective display means is directly associated, each of said display means comprising a first series of light sources adapted to be associated with the strings of a guitar, with each light source of the first series being associated with a respective string, and a second series of light sources respectively adapted to be associated with the frets of the guitar, means for receiving a stored data word sequence representing musical notes to be played by the instruments, a portion of said stored sequence representing the time intervals for which said notes are to be played, demodulator means comprising a plurality of storage registers corresponding with the number of display means, said data word sequence representing notes to be played on a corresponding number of musical instruments for the interval represented by said portion of said stored sequence, counting means connected with said demodulator means for gating data words for notes to be played on respective instruments to respective ones of said storage registers to thereby cause appropriate light sources in the displays for the plurality of instruments to operate simultaneously for facilitating the playing of the musical instruments simultaneously, and, decoder means connected with said demodulator means for receiving said data words in parallel and for operating a light source of each display in response to each parallel data word for the interval represented by said portion of said stored sequence.

* * * * *